United States Patent [19]

Woron

[11] 4,189,970

[45] Feb. 26, 1980

[54] METHOD AND APPARATUS FOR ACHIEVING TIMBRE MODULATION IN AN ELECTRONIC MUSICAL INSTRUMENT

[75] Inventor: Robert P. Woron, Allentown, Pa.

[73] Assignee: Allen Organ Company, Macungie, Pa.

[21] Appl. No.: 828,917

[22] Filed: Aug. 29, 1977

Related U.S. Application Data

[63] Continuation-in-part of Ser. No. 787,695, Apr. 14, 1977, abandoned.

[51] Int. Cl.[2] ..... G10H 1/04

[52] U.S. Cl. ..... 84/1.19; 84/1.24; 84/1.26

[58] Field of Search ..... 84/1.26, 1.24, 1.01, 84/1.11, 1.19

[56] References Cited

U.S. PATENT DOCUMENTS

| | | | |
|---|---|---|---|
| 3,610,799 | 10/1971 | Watson | 84/1.01 |
| 3,610,805 | 10/1971 | Watson et al. | 84/1.13 |
| 3,639,913 | 2/1972 | Watson | 84/1.01 |
| 3,740,450 | 6/1973 | Deutsch | 84/1.24 |
| 3,908,504 | 9/1975 | Deutsch | 84/1.26 |
| 3,972,259 | 8/1976 | Deutsch | 84/1.24 |
| 4,033,219 | 7/1977 | Deutsch | 84/1.26 |
| 4,134,321 | 1/1979 | Woron | 84/1.24 |

*Primary Examiner*—Gene Z. Rubinson
*Assistant Examiner*—Forester W. Isen
*Attorney, Agent, or Firm*—Seidel, Gonda, Goldhammer & Panitch

[57] ABSTRACT

In a digital musical instrument, timbre modulation is effected through the use of a digital magnitude comparator and associated digital logic. Selected note frequency signals and selected scale factors are compared in the digital magnitude comparator. Selected comparator outputs are applied to the associated digital logic in conjunction with a sample gating signal. This modulation results in a segmentation of the audio waveshape in accordance with the frequency signals selected for use in the comparator. Hence, choice of lower pitched frequency signals will result in a wider segmentation period, while choice of higher pitched frequency signals will narrow the segmentation period. Timbre modulation may be employed during note attack and/or decay.

8 Claims, 4 Drawing Figures

METHOD AND APPARATUS FOR ACHIEVING TIMBRE MODULATION IN AN ELECTRONIC MUSICAL INSTRUMENT

This is a continuation-in-part application of application Ser. No. 787,695 entitled "Method And Apparatus For Note Attack And Decay In An Electronic Musical Instrument" filed Apr. 14, 1977 in the name of Robert P. Woron now abandoned.

BACKGROUND OF THE INVENTION

1. Field of the Invention

This invention resides broadly in the field of electronic musical instruments and is particularly adaptable for use in instruments employing a time-division multiplexed signal for calling forth desired tones from those available in the instrument. The principles of the present invention are applicable to any digital electronic musical instrument in which musical sounds are generated in response to the actuation of key switches regardless of whether those switches are actuated directly, e.g. by the musician's fingers, or indirectly, e.g. by the plucking of strings. The term key is used in a generic sense to include depressible levers, actuable on-off switches, touch or proximity responsive devices, closable apertures and so forth. More particularly, the present invention relates to timbre modulation for electronic musical instruments.

2. Description of the Prior Art

Prior art attempts to simulate the transient voice effects of musical timbre have included the momentary sounding of independent "chiff" tones. As a result, the chiff or transient voice effect took on an independent character with limited dependence on the particular voices selected. U.S. Pat. No. 3,740,450 discloses a "chiff" of this type.

Prior art U.S. Pat. Nos. 3,908,504 and 3,972,259, while disclosing harmonic modulation and pulse width modulation respectively, employ complex and expensive hardware. The inventor knows of no prior art which affords the versatility and cost effectiveness of the present invention.

SUMMARY OF THE INVENTION

The present invention provides a new and unobvious approach to the accomplishment of timbre modulation which is particularly useful in digital electronic musical instruments. The present invention may be used during attack, decay, or both, thereby providing a variety of desirable musical effects.

Briefly, in accordance with the present invention, there is provided a digital magnitude comparator which compares selected note frequency signals to selected scale factors. The outputs of the digital magnitude comparator are combined in digital logic with a note attack and decay indicator signal. The output of this logic and a sample gating signal are applied to further digital logic to achieve timbre modulation. During note attack, the high output of the digital magnitude comparator will occur infrequently at first, but will occur more frequently as the scale factors increase in magnitude. The output of the comparator combined with the note attack and decay indicator signal is used to control the transmission of the sample gating signal of the waveshape generator. In the preferred embodiment, the control of the sample gating signal is in synchronism with the waveshape generator since common frequency signals are used for both the waveshape generator and the timbre modulation system. In this way the basic audio waveshape undergoes variable segmentation resulting in timbre modulation during attack. With this arrangement, organ "chiff" can effectively be simulated. It is obvious to those skilled in the art that the same principles can be applied during decay to create other musical effects. In addition, various combinations of frequency signals may be chosen for connection to the comparator. Different combinations of frequency signals result in different segmentation characteristics and therefore different timbre modulation characteristics. These optional arrangements facilitate accomplishing the particular "musical" objectives of the musical instrument designer.

In another variation of the present invention, frequency signals may be compared to an external digital signal. Timbre modulation will then be coordinated with the change in that external signal rather than attack and/or decay indicator signal. This allows still another option to the musical instrument designer in utilizing the invention.

BRIEF DESCRIPTION OF THE DRAWINGS

For the purpose of illustrating the invention, there are shown in the drawings forms which are presently preferred; it being understood, however, that the invention is not limited to the precise arrangement and instrumentalities shown.

DESCRIPTION OF THE PREFERRED EMBODIMENT

The present invention as described herein is presently viewed as the best mode of operation, it being understood that the principle of operation may be embodied in different forms by one skilled in the art. For the purpose of this disclosure the present invention will be described in conjunction with a demultiplexing audio waveshape generator. In the copending applications of the inventor, Robert P. Woron, entitled, "Demultiplexing Audio Waveshape Generator," Ser. No. 787,696 (now U.S. Pat. No. 4,134,321), and "Method and Apparatus for Note Attack and Decay in an Electronic Musical Instrument," Ser. No. 787,685 (now abandoned in favor of application Ser. No. 891,874), both filed on Apr. 14, 1977, and assigned to the same assignee as the present invention, there is described a demultiplexing audio waveshape generator with attack and decay particularly suited for use with the present invention. Electronic musical instruments or digital electronic musical instruments in which the present invention may be applied and used are described in detail in U.S. Pats. No. 3,610,799 and No. 3,639,913 of which the inventor was George A. Watson; and U.S. Pat. No. 3,610,805 of which the inventors were Ralph Deutsch and George A. Watson. Reference may be had to these patents and to the above mentioned copending application for demultiplexing audio waveshape generator for detailed description of components referred to herein other than the apparatus for timbre modulation.

Figure 1:
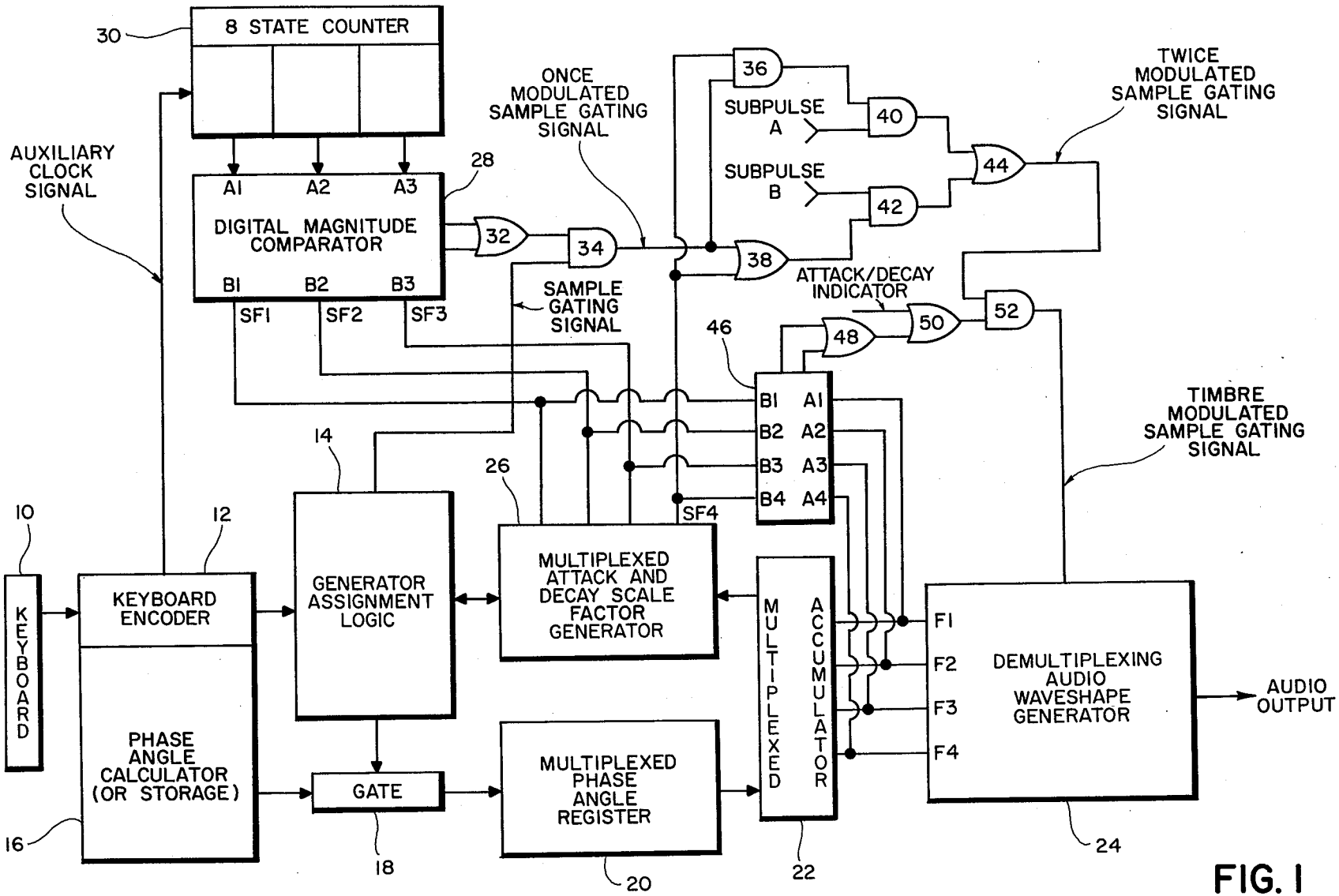
FIG. 1 is a block diagram of an electronic musical instrument utilizing the present invention.
Figure 2:
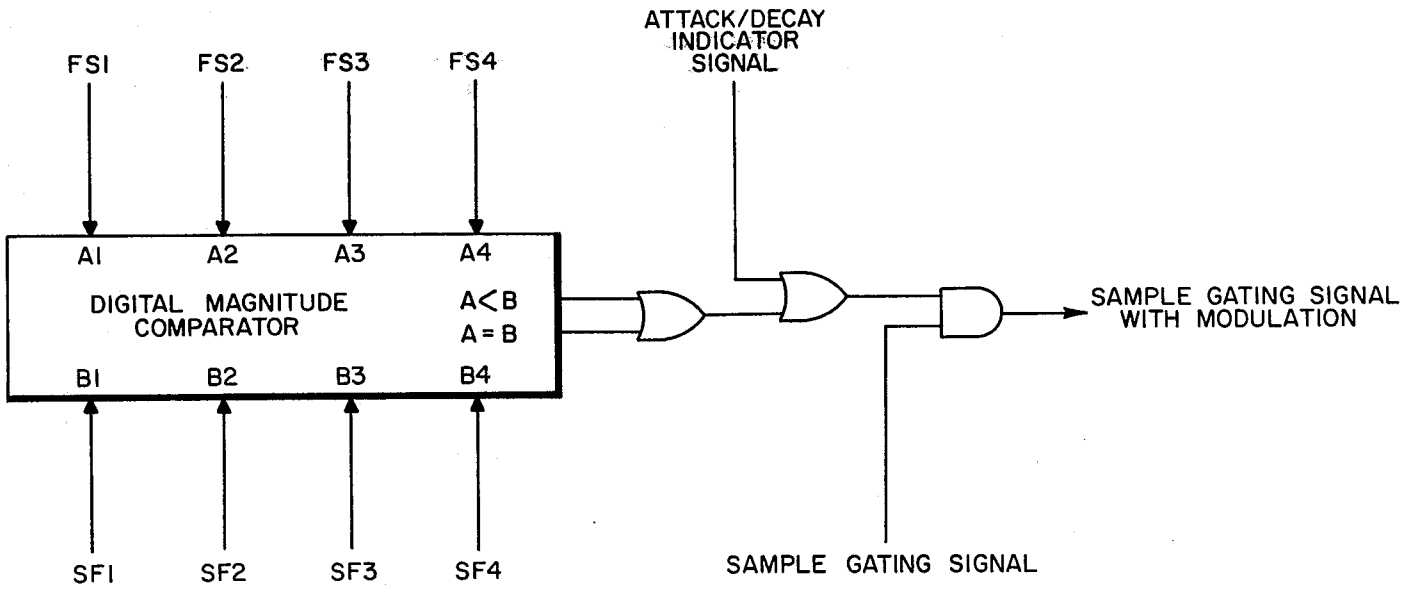
FIG. 2 is a logic diagram of the present invention.

For the purpose of describing the invention, reference will be made in detail to the drawings wherein like numerals indicate like elements. Referring to FIG. 1, there is shown in block diagram form an electronic musical instrument with timbre modulation. The instrument is clocked at a rate equal to and in synchronism with the multiplex cycle rate of the audio waveshape generator (typically 12 time slots of 1 μsecond duration). In the preferred embodiment digital magnitude comparator 46 compares the scale factor outputs from scale factor generator 26 to selected frequency signal information from the multiplexed accumulator 22. The scale factors, SF1, SF2, SF3, SF4 are applied independently to respective inputs B1, B2, B3, B4 of the digital magnitude comparator. The selected frequency signal information FS1, FS2, FS3, FS4 from multiplex accumulator 22 is applied independently to inputs A1, A2, A3, A4 of the digital magnitude comparator. Digital magnitude comparator 46 is a readily available standard component, e.g. Motorola part number MC14585CP. As a function of comparator 46, the magnitude of the A inputs from the multiplexed accumulator 22 are compared to the magnitude of the B inputs from the scale factor generator 26. The A<B and A=B outputs of the digital magnitude comparator are applied to "OR" gate 48. The output of "OR" gate 48 provides the function A=B. Therefore, as the attack and decay scale factor, input B, increases from zero to maximum in a particular multiplex channel, the high output of "OR" gate 48 will occur infrequently at first and gradually build in frequency until it is on continuously within the multiplex channel. When the scale factor is zero, the A<B output of the digital magnitude comparator 46 is always low because the output of the multiplex accumulator 22 is never less than zero. However, the A=B output of the digital magnitude comparator 46 will be high every time the selected outputs (FS) of the multiplexed accumulator 22 equal zero.

Figure 3:
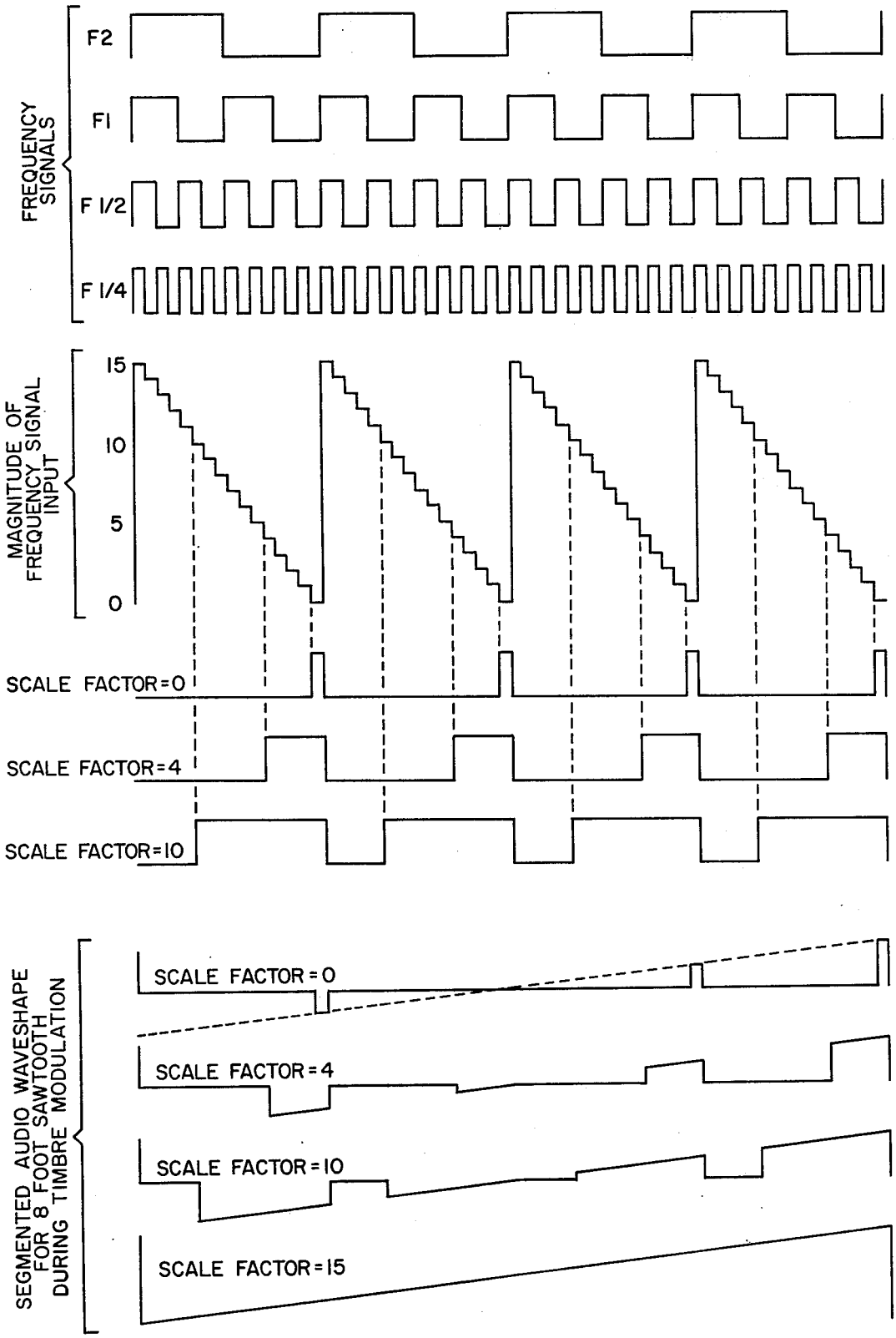
FIG. 3 is a timing diagram illustrating the operation of the digital magnitude comparator in relation to the basic audio waveshape to achieve timbre modulation using a two-foot frequency signal.

FIG. 3 is a timing diagram for a specific exemplary embodiment in which FS1, FS2, FS3 and FS4 are the chosen frequencies of F ¼, F ½, F1, and F2 respectively. The specific audio waveshape chosen to be generated by the demultiplexing audio waveshape generator is a simple eight (8) foot sawtooth as shown. Timbre modulation as disclosed in the instant invention functions by breaking the basic audio waveshape sawtooth into segments. The segmented waveshape has a much different timbre than that associated with the unsegmented sawtooth waveshape. Furthermore, different degrees of segmentation result in different timbres. As a result of causing this degree of segmentation to progressively change, the timbre of the segmented waveshape is modulated.

Referring again to FIG. 3, it can be seen that the magnitude of the chosen frequency signals (FS) sweeps from maximum to zero four times for each period of the basic 8 foot audio waveshape (sawtooth) causing four segmentation periods per audio waveshape. As the scale factor increases, the output of "OR" gate 48 is high for a progressively greater percentage of the time until the scale factor is at maximum, in which case the magnitude of the frequency signals (FS) in the digital magnitude comparator 46 is always less than or equal to the magnitude of the scale factor and consequently the output of "OR" gate 48 is maintained high.

Figure 3A:
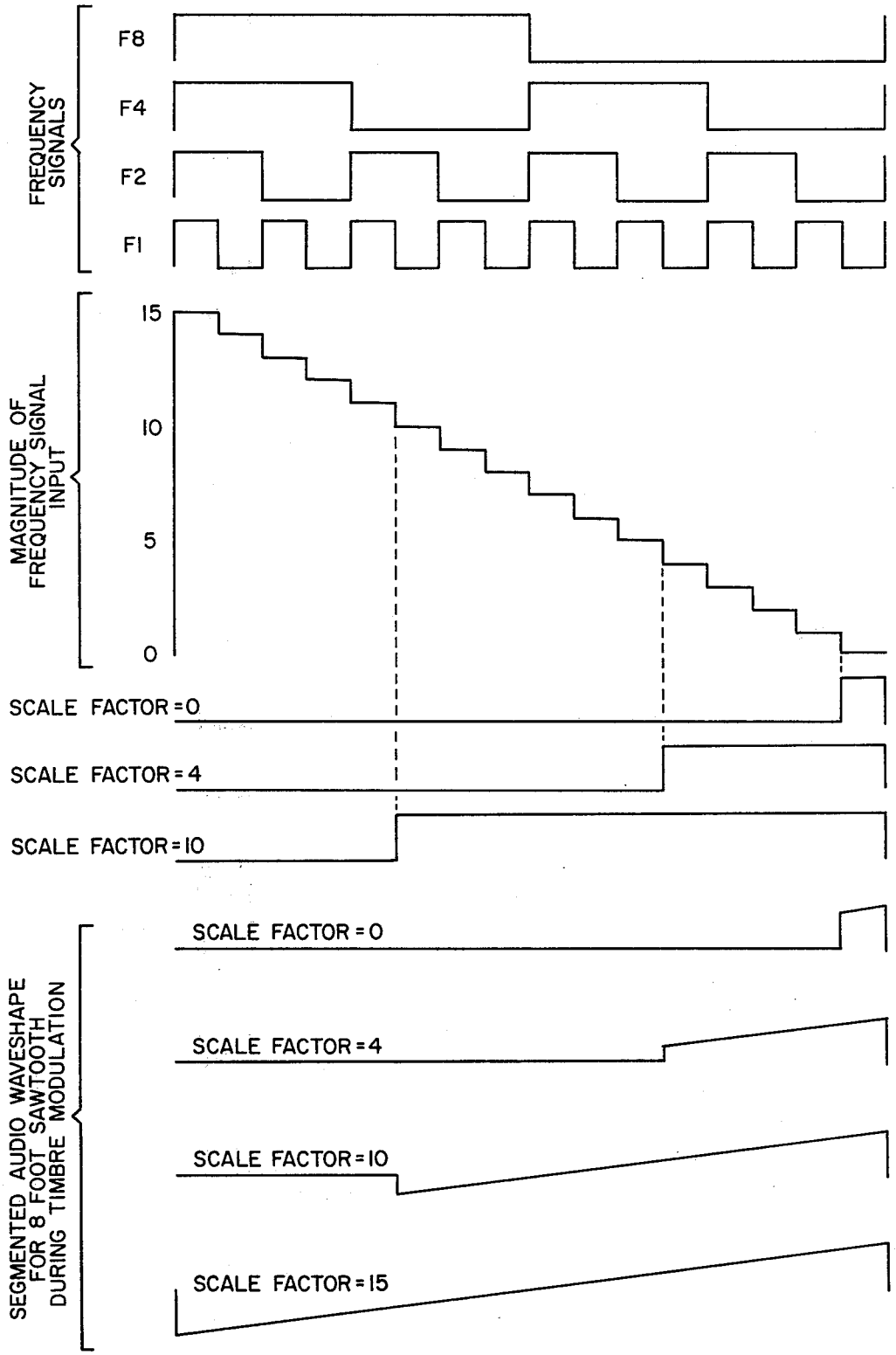
FIG. 3A is a timing diagram as in FIG. 3 for an eight-foot frequency signal.

The effect of the above described process on the basic audio waveshape is illustrated in FIG. 3. It can be seen that the severity of the waveshape segmentation will correspond to how infrequently the output of "OR" gate 48 goes high. As the high output of "OR" gate 48 occurs more frequently, the basic audio waveshape is less segmented. Finally, when the output of "OR" gate 48 is high continuously, the basic audio waveshape is gated on continuously without segmentation. This variable degree of segmentation results in the changing harmonic structure of timbre modulation. Compare this with FIG. 3A, wherein FS1, FS2, FS3 and FS4 are chosen as frequencies of F1, F2, F4 and F8 respectively. The waveshape to be modulated is again an eight (8) foot sawtooth. The modulation will be accomplished as explained above; however, it can be seen that due to the musical pitch of the chosen frequency signals (FS), the magnitude of the chosen frequency signal (FS) progresses from maximum to zero only once during the period of the basic eight (8) foot sawtooth audio waveshape. Thus different combinations of frequency signals may be chosen depending on the musical effect desired. Also, it will be noted that the output of "OR" gate 48 at each respective scale factor is different.

Referring again to FIG. 1, the output of "OR" gate 48 depends on the magnitude of the scale factor and the instantaneous magnitude of the chosen frequency signals (FS). The output of the "OR" gate 48 is high whenever the magnitude of the frequency signals (FS) is less than or equal to the magnitude of the scale factor.

Since the outputs of the digital magnitude comparator 46 are synchronous with the audio waveshape cycle, it will achieve the segmentation sequence in synchronization with the audio waveshape frequency. The principle of operation is not dependent upon the frequencies selected.

The high output of "OR" gate 48 may be used for several different modulations. In the preferred embodiment of FIG. 1, the output of "OR" gate 48 is applied to one input of "OR" gate 50 and the attack and decay indicator signal is applied to the other input. An explanation of the attack and decay indicator signal is presented in the U.S. Pat. No. 3,610,799. A functional definition of the attack and decay signal for purposes of disclosing the present invention is a digital signal related to key activity for indicating the attack or decay mode. In the preferred embodiment a signal logic "0" indicates attack and logic "1" indicates decay. Again referring to FIG. 1, it can be seen that when the attack indication is a logic "0", "OR" gate 50 will only have a high output when the input from "OR" gate 48 is high. Thus, the timbre modulation explained hereinabove will only be operative during the attack period. The output of "OR" gate 50 is applied to "AND" gate 52. The sample gating signal, which in the preferred embodiment is the twice modulated sample gating signal, as disclosed in copending patent application Ser. No. 787,695, is also applied to "AND" gate 52. A functional definition of the sample gating signal for purpose of disclosing the present invention is a digital signal related to key selection for controlling the instantaneous response of the audio waveshape generator. As a function of "AND" gate 52, the modulated sample gating signal will be timbre modulated as explained hereinabove.

Due to the function of "OR" gate 50, in cooperation with attack and decay indicator signal, there will be no timbre modulating during the decay mode, since the attack and decay indicator signal is logic "1". If the timbre modulation is desired only during the decay mode, the attack/decay indicator signal may be inverted before presentation to "OR" gate 50 thereby inverting the decay logic "1" to logic "0". Timbre modulation during decay is useful for simulating plucked strings or creating more novel "synthesizer" effects. If timbre modulation is desired in both the attack and decay mode, the elimination of "OR" gate 50 will provide the desired result. The signal from "OR" gate 48 is applied directly to "AND" gate 52 resulting in timbre modulation during both attack and decay.

It is not mandatory to use the scale factors (SF) as the "B" inputs to the comparator. The attack and decay scale factors have been selected so that the timbre modulation is synchronized with the attack and/or decay of the keyed notes. This is desired when simulating the transient effects such as those associated with organ pipe "chiff" or plucked strings. However, any external varying or variable digital signal may be applied to the "B" inputs of the comparator. The timbre modulation effect will then be coordinated with the change in this external digital signal.

The specific number and arrangements of the digital magnitude comparator inputs and outputs as disclosed herein are only those associated with the preferred embodiment. However, it will be obvious to one skilled in the art that other combinations and arrangements may be used without deviating from the foregoing disclosed invention.

Additionally, the invention has been disclosed in conjunction with a multiplexed note frequency signal source; the invention may be used in non-multiplexed instruments by providing a timbre modulation apparatus for each non-multiplexed tone source.

Thus, the present invention may be embodied in other specific forms without departing from the spirit of the essential attributes thereof, and, accordingly, reference should be made to the appended claims rather than the foregoing specifications as indicating the scope of the invention.

I claim:

1. Apparatus for achieving timbre modulation in an electronic musical instrument including an audio wave shape generator responsive to octavely related note frequency signals, comprising:

means for generating a variable magnitude digital signal, means connected to the audio wave shape generator for generating octavely related note frequency signals, digital magnitude comparator means for comparing said variable digital signal with said octavely related note frequency signals and for producing an output signal based on predetermined comparisons, means for generating a sample gating signal indicative of the desired state of the audio wave shape generator, and digital logic means connected to the audio wave shape generator for accepting said sample gating signal and said digital magnitude comparator output signal and for producing a timbre modulated sample gating signal for controlling the audio wave shape generator.

2. The apparatus according to claim 1 wherein said means for generating said octavely related note frequency signals includes a multiplexed accumulator.

3. The apparatus according to claim 1 wherein said means for generating said variable magnitude digital signal includes a multiplexed attack and decay scale factor generator.

4. The apparatus according to claim 1 further comprising means for generating an attack and decay indicator signal for selectively enabling and disabling said digital logic.

5. The method of achieving timbre modulation of the wave shape generated by an audio wave shape generator, comprising:

(a) generating a variable magnitude digital signal, (b) generating octavely related note frequency signals, (c) comparing said variable magnitude digital signal with said octavely related note frequency signals and producing an output signal in response to predetermined comparisons, (d) generating a digital sample gating signal indicative of the desired state of the audio wave shape generator, and (e) combining said digital magnitude comparator output signal and said digital sample gating signal to produce a timbre modulated sample gating signal for controlling the audio wave shape generator.

6. The method according to claim 5 wherein said step (a) includes generating a multiplexed variable magnitude digital signal with respect to plural wave shape generator channels.

7. The method according to claim 5 wherein said step (b) includes generating multiplexed octavely related note frequency signals with respect to plural wave shape generator channels.

8. The method according to claim 5 including the steps of generating an attack and decay indicator signal and selectively combining said digital magnitude comparator output signal and said digital sample gating signal based on said attack and decay indicator signal.

* * * * *